US005473823A

United States Patent [19]

Powell

[11] Patent Number: 5,473,823

[45] Date of Patent: Dec. 12, 1995

[54] MINI-ROLLER CLEANING TOOL

[76] Inventor: James Powell, 844 E. Meadow Ct., Draper, Utah 84020

[21] Appl. No.: 320,578

[22] Filed: Oct. 11, 1994

[51] Int. Cl.[6] ..... F26B 17/24

[52] U.S. Cl. ..... 34/58; 15/246; 15/38

[58] Field of Search ..... 34/58, 59, 312; 15/236.03, 246, 159.1, 105, 38

[56] References Cited

U.S. PATENT DOCUMENTS 2,794,265 6/1957 Kruger ..... 34/58
2,884,709 5/1959 Kruger ..... 34/58
3,925,908 12/1975 Dunn ..... 34/58
5,185,938 2/1993 Hutt ..... 34/58

*Primary Examiner*—Denise L. Gromada
*Attorney, Agent, or Firm*—Thorpe North & Western

[57] ABSTRACT

A mini-roller cleaning tool is disclosed including an adaptor for positioning adjacent the arms of a paint brush spinner, and a shaft for securing a mini-roller to the adaptor such that when the adaptor handle is rotated, the mini-roller is spun to remove paint from the mini-roller by centrifugal force. In accordance with one aspect of the invention, grips are provided to facilitate positioning the adaptor between the arms of the paint brush spinner without injuring the user's hands.

18 Claims, 3 Drawing Sheets

MINI-ROLLER CLEANING TOOL

BACKGROUND OF THE INVENTION

The present invention relates to a mini-roller cleaning tool and, in particular, to an adapter for enabling a mini-roller to be attached to traditional cleaning devices so as to facilitate cleaning of the mini-roller.

The use of mini-rollers has become common place in painting and other related industries. These rolling paint brushes, often referred to as Seven Inch Rollers and Weenie Rollers, are different from conventional paint rollers in that they have an overall diameter of approximately 1 inch, and a hollow center with a diameter of approximately one-quarter of an inch. The mini-rollers were originally developed for painting in hard to reach areas, such as behind toilets. However, the use of mini-rollers for other painting applications has spread because of their convenient size, and the ease with which they may be used in tight corners, etc.

One major problem with the mini-rollers is that, until the present invention, there has been no practical way to clean the rollers once they are used. Conventional brushes and rollers are usually cleaned by using a paint brush/roller cover spinner. A paint brush/roller cover spinner is typically a hand held device which has a pair of arms which hold a standard sized paint brush handle, or fit within the hollow center of a traditional roller. Once the roller or handle is secured by the arms, a force is applied to the handle causing the paint brush or roller to spin, thereby using centrifugal force to expel left over paint from the brush. The force is usually applied by holding a body of the paint brush spinner and pushing a handle towards the body. A shaft connecting the handle and the body translates axial movement of the handle into radial movement by the arms, and causes the arms to rotate at a high rate of speed.

Another common version of the paint brush spinner utilizes a water pressure from a hose to rotate the arms. By utilizing water pressure, higher rotational velocities can be achieved.

Because of the design of most paint brush/roller cover spinners, it has been impractical before the present invention to use a paint brush spinner to clean mini-rollers. Instead, the mini-roller is usually thrown away, no matter how short the use, because paint cannot be removed from the roller. As the paint dries, the mini-roller becomes unusable. Because mini-rollers tend to be rather expensive, their routine disposal creates both environmental and economic waste.

Thus, there is a need for an device which will enable painters to use a mini-roller with a paint brush spinner to clean the rollers so that they may be reused.

SUMMARY OF THE INVENTION

It is an object of the present invention to provide an adapter/tool to enable mini-rollers to be cleaned with conventional paint brush spinners.

It is another object of the present invention to provide an adapter/tool which is inexpensive.

It is yet another object of the present invention to provide an adapter/tool which requires minimal effort to adapt a conventional paint brush spinner for use with mini-rollers.

The above and other objects of the invention are realized in specific illustrated embodiments of a mini-roller cleaning tool including an elongate adapter for disposition adjacent the arms of the paint brush spinner and an elongate shaft for holding a mini-roller coaxially with the elongate shaft such that rotation of the arms of the paint brush spinner causes a corresponding rotation of the mini-roller to thereby use centrifugal force to remove paint from the mini-roller.

In accordance with one aspect of the invention, the elongate adapter has a pair of projections for enabling a user to insert the handle into the arms of the paint brush spinner without damaging his or her hands.

In accordance with another aspect of the invention, the shaft has a retention mechanism for maintaining the mini-roller on the shaft when the paint brush spinner is in use.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
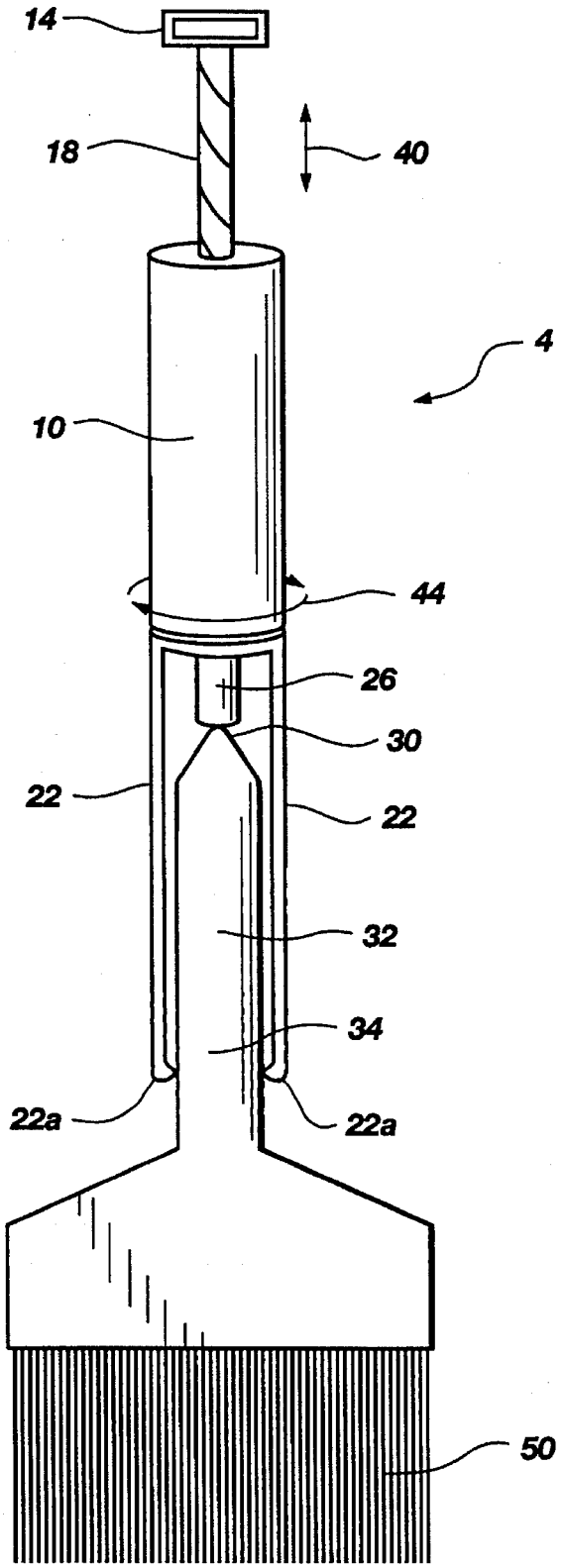
Fig. 1 (PRIOR ART)
FIG. 1 is a perspective view of conventional paint brush spinner, such as those used to clean paint brushes and traditional paint rollers, with a paint brush mounted therein.

Reference will now be made to the drawings in which the various elements of the present invention will be given numeral designations and in which the invention will be discussed so as to enable one skilled in the art to make and use the invention. Referring to FIG. 1, there is shown a conventional paint brush spinner, generally indicated at 4. The paint brush spinner 4 has a generally cylindrical body 10. A handle 14 is connected to the body 10 by a grooved shaft 18. On an opposite side of the body 10, a pair of arms 22 extend away from the body in a generally parallel orientation. The arms 22 are maintained in this position by a resilient force, such as a spring, so that when they are rotated, they will not extend radially outward. Between the arms 22 is a base 26. The base 26 has a impression formed therein for receiving a pointed end 30 of a paint brush handle 32. When the paint brush handle 32 is so disposed, the arms 22 hold the handle 32 securely, so that when the paint brush handle will not escape when it is rotated.

In use, the paint brush handle 32 is placed between the arms 22 by sliding the point end 30 through the ends **22*a* of the arms 22 until it rests in the base 26. As was mentioned previously, the resilient force connected to the arms 22 will hold the handle 32 of the paint brush 34 in place. The paint brush spinner 4 is gripped about the body 10 by one hand and on the handle 14 by the other. As the handle 14 is pushed into and pulled out of the body 10, as indicated by arrow 40, the arms 22 (and the paint brush 34) will rotate at a high rate of speed in the direction indicated by arrows 44. As the paint brush 34 spins, centrifugal force expels most of the paint in the bristles 50** of the paint brush. Once most of the paint has been removed, paint thinner or other cleaner can be used to remove any residual paint. Those skilled in the art will appreciate that the spinning portion of this procedure is usually done while the brush is positioned in a five gallon bucket or some other container so that the paint will not spray onto surrounding persons or structures.

When used with a conventional roller, the spinner 4 is used somewhat differently. Instead of placing a handle between the arms 22, the arms are slid into the hollow cavity inside the roller. As can be seen from FIG. 1, the arms 22 are slightly tapered, so that the roller may slide onto the arms to a point at which the roller is held about the arms. Pumping the handle 14 causes the arms 22, and thus the roller, to rotate, thereby removing excess paint. As will be appreciated, however, such a method would not work with mini-rollers as they have a hollow with a diameter of less than one-quarter of an inch, much smaller than that of a conventional roller.

Figure 2:
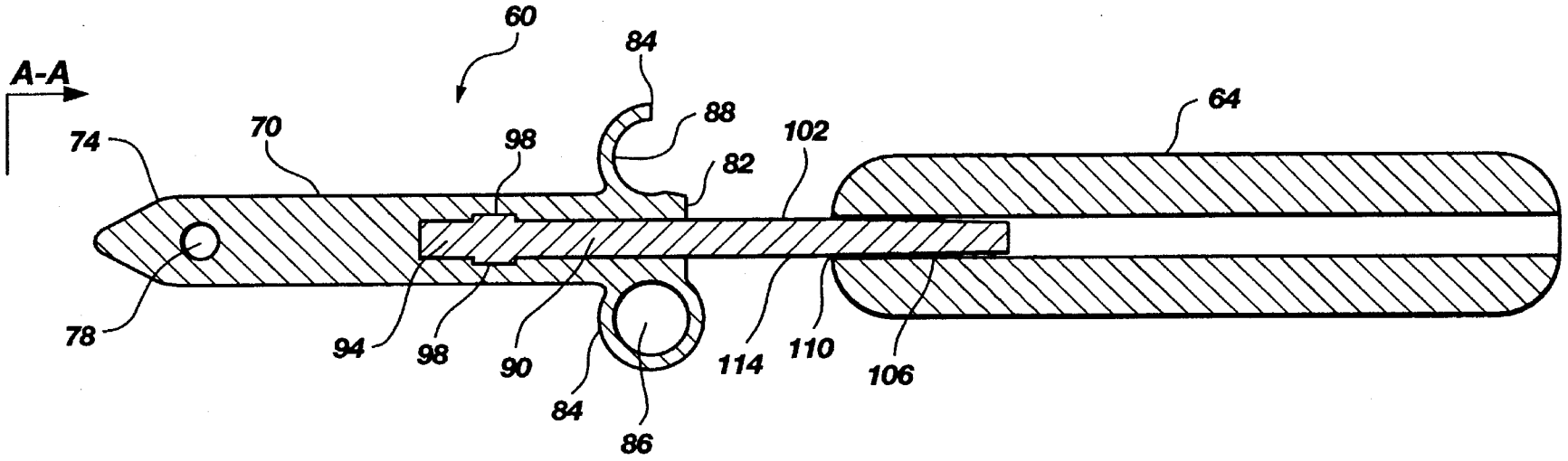
FIG. 2 is a side cross-sectional view of a mini-roller cleaning tool with a mini-roller attached as would occur in use so to enable a mini-roller to be used with a paint brush spinner.

Referring now to FIG. 2, there is shown a side cross-sectional view of a mini-roller cleaning tool, generally indicated at 60, and a mini-roller 64. The mini-roller cleaning tool 60 includes an adaptation means in the form of an elongate handle portion 70 which will typically be made of a durable plastic, such as PVC, or some other thermosetting material. While such materials will lower cost, those skilled in the art will recognize that the handle portion 70 could be made of numerous durable materials, such as metal, wood, or other composites. As will be discussed in more detail regarding FIG. 3, the handle can have any cross-sectional shape. However, in a preferred embodiment, the handle portion 70 will have a similar shape and cross-section to that of a conventional paint brush. Such a shape guarantees that the handle portion 70 will fit properly within the arms 22 (FIG. 1) of the paint brush spinner 4 (FIG. 1).

One end 74 of the handle portion 70 has a hole 78 formed therein so that the cleaning tool 60 can be hung from a hook, etc., when not in use. At an opposing end 82, a pair of gripping means 84 extend from the handle portion 70. In a preferred embodiment, the gripping means is formed by a generally circular ring providing a finger hold 86 which extends transversely from the handle portion 70. Alternatively, the gripping means may be formed by a semicircular finger hold 88, or even by the base of the handle portion. Typically both gripping means will be the same. The circular finger hold 86 will typically have a diameter of about two-thirds of an inch to accommodate most human fingers. The semicircular finger hold 88 would have a similar curvature. By using the finger holds, the user can insert the handle portion 70 between the arms 22 (FIG. 1) without his or her hand contacting the arms. Because most paint brush spinners 4 (FIG. 1) require significant force to position the handle portion 70 between the arms 22 (FIG. 1), the user's hands could be bruised if handle portion 70 is positioned between the arms too quickly. Those skilled in the art will recognize and appreciate that numerous other gripping means could be used to avoid forceful contact between the user's hand and the arms 22 (FIG. 1).

Partially disposed within the handle portion 70 of the cleaning tool 60 is a retention means in the form of an elongate shaft 90 extending coaxially from the handle portion 70 and holding the mini-roller 64 to the handle portion 70. As with the handle portion 70, the shaft 90 can be made of virtually any rigid material. It is anticipated, however, that the shaft will use a nickel plated steel rod. While the shaft 90 may be solid, as is shown in FIG. 2, the use of nickel and other durable materials will enable the shaft to be hollow, thereby decreasing weight and shipping costs. While discussed as being generally cylindrical, the shaft 90 could have almost any cross-sectional shape.

Near a first end 94 which is disposed within the handle portion 70, a pair of "dog ears" 98 extend from the shaft 90. The dog ears 98 enable the shaft 90 to remain securely held by the handle portion 70 when the handle portion is formed by an injection molding process. Dog ears 98 would also likely be used if the handle portion 70 was formed in two pieces and then attached about the shaft 90.

As is shown in FIG. 2, the shaft 90 is of a generally constant diameter until a short distance from the handle portion 70. The shaft 90 then beings to taper, as shown in FIG. 2 at 102. This tapering of the shaft 90 allows the shaft to fit within the hollow 106 of the mini-roller 64. Ideally, the shaft 90 will taper from a diameter of about 0.37 inches to a diameter of about 0.24 inches over a one to two inch section, after which the final section of the shaft remains of a constant diameter so as to fit securely within the mini-roller 64. The opening 110 of the hollow 106 is usually bevelled on a mini-roller 64. As the tapered section 102 of the shaft 90 slides into the hollow 106 of the mini-roller 64, the opening of the hollow 110 will come to a point at which the frictional force between the tapered section 102 and the opening 110 is sufficient to hold the mini-roller 64 about the shaft 90. To further assist this arrangement, a preferred embodiment has a medium diamond knurl 114 along the tapered section 102 to increase the frictional attachment with the mini-roller 64. This arrangement ensures that the mini-roller 64 will not accidently come off of the shaft 90 while it is being spun clean.

Those skilled in the art will appreciate that the mini-roller 64 can the attached to the shaft 90 before the handle portion 70 is placed between the arms 22 (FIG. 1), or that the handle portion can be placed within the arms 22 prior to attaching the mini-roller. Once the handle portion 70 is between the arms 22 (FIG. 1) so that the end 74 is adjacent the base 26 (FIG. 1) and the mini-roller 64 is attached to the shaft 90, the paint brush spinner 4 (FIG. 1) can be used as described above to remove excess paint from the mini-roller 64. Thus, the cleaning tool 60 quickly and efficiently recycles a mini-roller which otherwise would be thrown away regardless of the length of use.

Figure 3:
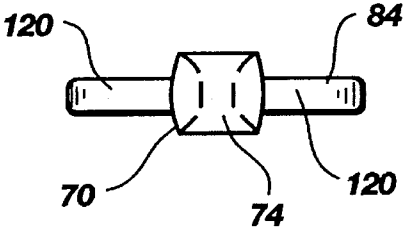
FIG. 3 is a perspective view of a handle portion of the mini-roller cleaning tool taken along the line A—A shown in FIG. 2.

Referring now to FIG. 3, there is shown a perspective view of the handle portion 70 taken along the line A—A in FIG. 2. As was shown in FIG. 2, the handle portion 70 has a generally rectangular shape. Those skilled in the art, however, will recognize that virtually any shape may be used which will enable the handle portion 70 to be held between the arms 22 of the paint brush spinner 4 (FIG. 1). Preferentially, the end 74 of the handle portion 70 tapers inwardly so as to rest in the base 26 (FIG. 1) of the paint brush spinner 4 (FIG. 1). As shown in FIG. 3, the gripping means 84 are formed by a pair of straight projections 120, instead of the circular finger hold 86 or semicircular finger hold 88 shown in FIG. 2. While straight projections 120 are less desirable than the circular and semicircular holds of FIG. 2, they still enable a user to properly position the handle portion 70 between the arms 22 (FIG. 1) without contacting the arms with his or her hand. Thus, regardless of which gripping means is used, the user's hands are protected against damage by the arms 22 (FIG. 1).

Figure 4:
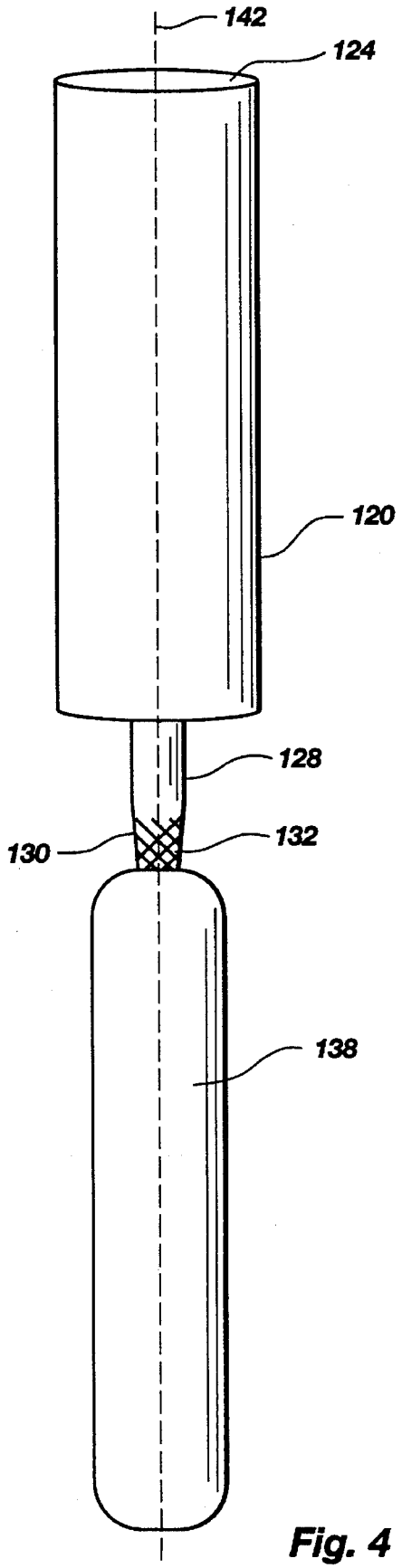
FIG. 4 is a perspective view of an alternate embodiment of the invention.

In FIG. 4, there is shown another embodiment of the present invention. Instead of a handle portion as shown at 70 in FIG. 2, the adaptation means includes a generally hollow cylinder 120 having a diameter similar to that of a conventional roller. An opening 124 at one end of the cylinder 120 allows the cylinder to be slid onto the arms 22 (FIG. 1) of the paint brush spinner 4 (FIG. 1) in the manner described regarding FIG. 1. Typically, the cylinder 120 will be made of metal or a durable composite, such as PVC. As with the embodiment discussed regarding FIGS. 2 and 3, an elongate shaft 128 extends coaxially from the cylinder 120. Those skilled in the art will recognize numerous methods for attaching the shaft 128 to the cylinder 120, such as adhesives, welding, or a nut/bolt combination. The shaft 128 has a tapered section 130 which contains diamond knurl 132 to provide adequate friction between the shaft and a mini-roller 138.

As will be appreciated by those skilled in the art, because the cylinder 120 mounts about the outsides of the arms 22 (FIG. 1) of the paint brush spinner 4 (FIG. 1), the need for gripping means, such as those at 84 in FIGS. 2 and 3, is reduced. However, gripping means could easily be added if desired.

When the cylinder 120 is mounted on the paint brush spinner 4 (FIG. 1), the cylinder, the shaft 128 and the mini-roller 138 will rotate about the axis 142, when the handle 14 (FIG. 1) is pushed into or pulled out of the body 10 (FIG. 1). The centrifugal force developed will rid the mini-roller 138 of paint so that the mini-roller may be used repeatedly.

In the manner described, a mini-roller cleaning tool is provided. By using the above described tool, substantial economic and environmental waste can be avoided, as mini-rollers may be used repeatedly, rather than being discarded after any use. It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A mini-roller cleaning tool for enabling paint brush spinners, which include retaining arms extending along an axis of rotation of the paint brush spinner, to clean mini-rollers which comprise a cylindrical painting sheath and an internal opening for mounting a roller arm, the cleaning tool comprising:

adaptation means for contacting the arms of the paint brush spinner such that the adaptation means is held in place by the arms, and such that rotation of the arms rotates the adaptation means in a like direction, the adaptation means having an axis of rotation; and retention means for connecting a mini-roller to the adaptation means such that rotation of the adaptation means causes a like rotation of the mini-roller, the retention means comprising an elongate shaft extending coaxially with the axis of rotation of the adaptation means.

2. The mini-roller cleaning tool of claim 1, wherein the adaptation means includes an elongate handle portion.

3. The mini-roller cleaning tool of claim 2, wherein the elongate shaft comprises a tapered section for frictionally interacting with the internal opening of the mini-roller so as to hold the mini-roller about the shaft.

4. The mini-roller cleaning tool of claim 3, wherein the tapered section comprises a roughened external section for increasing friction attachment between the shaft and the mini-roller.

5. The mini-roller cleaning tool of claim 4, wherein the roughened section comprises diamond knurl.

6. The mini-roller cleaning tool of claim 1, wherein the adaptation means comprises an elongate, generally hollow cylinder.

7. The mini-roller cleaning tool of claim 6, wherein the retention means comprises an elongate shaft extending coaxially from the cylinder, the shaft having a generally tapered section for frictionally holding a mini-roller about the shaft.

8. The mini-roller cleaning tool of claim 1, further comprising gripping means extending transversely from the cleaning tool for enabling the tool to be held by a user without gripping the adaptation means.

9. The mini-roller cleaning tool of claim 8, wherein the gripping means comprises at least one circular finger hold for enabling a finger grip by a hand of a user.

10. The mini-roller cleaning tool of claim 8, wherein the gripping means comprises at least one semicircular finger hold for enabling a finger grip by a hand of a user.

11. The mini-roller cleaning tool of claim 8, wherein the gripping means comprises at least one straight projection extending transversely from the adaptation means for enabling a finger grip by a hand of a user.

12. A mini-roller cleaning tool for enabling paint brush spinners which include retaining arms extending along an axis of rotation of the paint brush spinner to clean mini-rollers which comprise a cylindrical painting sheath and an internal opening for mounting a roller arm, the cleaning tool comprising:

adaptation means for fitting adjacent arms of the paint brush spinner such that the arms hold the adaptation means to the paint brush spinner, and such that rotation of the arms rotates the adaptation means in a like direction;

retention means for temporarily connecting a mini-roller to the adaptation means such that rotation of the adaptation means causes a like rotation of the mini-roller, the retention means comprising an elongate shaft and means for attaching a mini-roller to the elongate shaft; and gripping means extending outwardly from the adaptation means so as to facilitate holding of the adaptation means when fitting the adaptation means between the arms of the paint brush spinner.

13. The mini-roller cleaning tool of claim 12, wherein the adaptation means comprises an elongate handle, and wherein the gripping means comprises a pair of finger holds extending outwardly from the handle for enabling a finger grip by a hand of a user.

14. A mini-roller cleaning tool for enabling paint brush spinners, which include retaining arms extending along an axis of rotation of the paint brush spinner, to clean mini-rollers which comprise a cylindrical painting sheath defining a hollow and an opening for mounting a roller arm in the hollow, the cleaning tool comprising:

adaptation means for contacting the arms of the paint brush spinner such that the adaptation means is held in place by the arms, and such that rotation of the arms rotates the adaptation means in a like direction; and retention means for connecting a mini-roller to the adaptation means such that rotation of the adaptation means causes a like rotation of the mini-roller, the retention means comprising a generally cylindrical shaft.

15. The mini-roller cleaning tool of claim 14, wherein the opening of the mini-roller includes a known diameter, and wherein the shaft comprises a first section of a diameter larger than the diameter of the opening in the mini-roller, and a second section of a diameter slightly smaller than that of the opening in the mini-roller, such that the second section may fit within the opening, but the first section may not.

16. The mini-roller cleaning tool of claim 15, wherein first and second sections of the shaft are connected by a tapered section such that the second section of the shaft can be slid within the hollow of the mini-roller until the opening of the mini-roller frictionally contacts the tapered section.

17. The mini-roller cleaning tool of claim 16, wherein the tapered section of the shaft comprises diamond knurl.

18. The mini-roller cleaning tool of claim 14, wherein the shaft is formed of nickel plated steel.

* * * * *